US009631438B2

(12) United States Patent
McKay

(10) Patent No.: US 9,631,438 B2
(45) Date of Patent: Apr. 25, 2017

(54) CONNECTOR

(75) Inventor: David Ernest McKay, Stonehaven (GB)

(73) Assignee: Subsea Technologies Group Limited (GB)

( * ) Notice: Subject to any disclaimer, the term of this patent is extended or adjusted under 35 U.S.C. 154(b) by 0 days.

(21) Appl. No.: 14/127,100

(22) PCT Filed: May 18, 2012

(86) PCT No.: PCT/GB2012/051125
§ 371 (c)(1),
(2), (4) Date: Jan. 10, 2014

(87) PCT Pub. No.: WO2012/156751
PCT Pub. Date: Nov. 22, 2012

(65) Prior Publication Data

US 2014/0144648 A1 May 29, 2014

(30) Foreign Application Priority Data

May 19, 2011 (GB) ..... 1108415.9

(51) Int. Cl.
*E21B 33/038* (2006.01)
*E21B 33/076* (2006.01)
(Continued)

(52) U.S. Cl.
CPC ..... *E21B 17/02* (2013.01); *E21B 17/01* (2013.01); *E21B 19/006* (2013.01); *E21B 33/02* (2013.01); *E21B 33/035* (2013.01); *E21B 33/038* (2013.01)

(58) Field of Classification Search
CPC ..... E21B 33/038; E21B 33/076; E21B 17/01; E21B 33/043; E21B 33/035
(Continued)

(56) References Cited

U.S. PATENT DOCUMENTS 3,032,125 A * 5/1962 Hiser ..... E21B 17/01 166/341
3,498,324 A * 3/1970 Breuning ..... F16L 37/23 137/614.04

(Continued)

FOREIGN PATENT DOCUMENTS

GB 2447645 A 9/2008
WO WO-2009061211 A2 5/2009

OTHER PUBLICATIONS

Maukonen, Kalle, "International Search Report", prepared for PCT/GB2012/051125 as mailed Mar. 1, 2013, 3 pages.

*Primary Examiner* — Matthew R Buck
*Assistant Examiner* — Edwin Toledo-Duran
(74) *Attorney, Agent, or Firm* — Abel Law Group, LLP

(57) ABSTRACT

A connector is disclosed for connecting components of a subsea conduit system extending between a wellhead and a surface structure, for example, a riser system. Male and female components are provided, and a latching device to releasably latch the male and female components together when the two are engaged. The male and female components incorporate a main sealing device to seal the male and female components together to contain the high pressure wellbore fluids passing between them when the male and female components are engaged. The latching device also incorporates a second sealing device configured to contain fluids when the male and the female components are disengaged, so that during disconnection, any fluids escaping the inner conduit are contained.

26 Claims, 10 Drawing Sheets

(51) Int. Cl.

| | |
|---|---|
| ***E21B 33/043*** | (2006.01) |
| ***E21B 33/035*** | (2006.01) |
| ***E21B 17/02*** | (2006.01) |
| ***E21B 19/00*** | (2006.01) |
| ***E21B 17/01*** | (2006.01) |
| ***E21B 33/02*** | (2006.01) |

(58) Field of Classification Search
USPC ..... 166/338, 339, 340, 341, 344, 345, 348, 166/351, 360, 377, 378, 367, 355, 359
See application file for complete search history.

(56) References Cited

U.S. PATENT DOCUMENTS 3,510,153 A * 5/1970 Newton ..... E21B 33/038 285/18
3,551,005 A * 12/1970 Brun ..... E21B 33/038 166/341
3,701,549 A * 10/1972 Koomey ..... E21B 33/038 285/113
3,841,665 A * 10/1974 Capot ..... E21B 33/035 166/340
4,138,148 A * 2/1979 Zaremba ..... E21B 33/038 166/340
4,174,875 A * 11/1979 Wilson ..... H01R 13/523 439/190
4,185,856 A * 1/1980 McCaskill ..... E21B 17/085 166/340
4,325,409 A * 4/1982 Roberts ..... E21B 33/0355 137/596.14
4,347,012 A * 8/1982 Glidden ..... B63B 21/50 114/230.2
4,460,156 A * 7/1984 Hazelrigg ..... E21B 33/0355 137/614.04
4,489,959 A * 12/1984 Satterwhite ..... E21B 33/038 285/18
4,635,728 A * 1/1987 Harrington ..... E21B 43/017 166/341
4,673,041 A * 6/1987 Turner ..... E21B 33/076 166/340
4,679,824 A * 7/1987 Rodriguez ..... E21B 33/0355 285/27
4,902,044 A * 2/1990 Williams ..... E21B 33/038 166/340
5,168,933 A * 12/1992 Pritchard, Jr. ..... E21B 33/043 166/212
5,318,384 A * 6/1994 Maloberti ..... F16L 1/166 166/338
5,947,642 A * 9/1999 Teixeira ..... E21B 19/004 166/340
6,234,252 B1 * 5/2001 Pallini, Jr. ..... E21B 33/038 166/345
6,470,975 B1 * 10/2002 Bourgoyne ..... E21B 21/001 166/367
6,890,005 B1 * 5/2005 Chisnell ..... F16L 41/086 285/124.1
6,913,092 B2 * 7/2005 Bourgoyne ..... E21B 21/001 175/195
7,159,669 B2 * 1/2007 Bourgoyne ..... E21B 21/001 166/348
7,225,877 B2 * 6/2007 Yater ..... B63B 27/34 166/338
7,237,623 B2 * 7/2007 Hannegan ..... E21B 21/08 175/195
7,487,837 B2 * 2/2009 Bailey ..... E21B 33/085 166/250.01
7,658,228 B2 * 2/2010 Moksvold ..... E21B 17/01 166/345
7,866,399 B2 * 1/2011 Kozicz ..... E21B 17/01 166/344
7,967,070 B2 * 6/2011 Reddy ..... E21B 17/017 166/341
7,997,345 B2 * 8/2011 Hannegan ..... E21B 33/085 166/345
8,322,432 B2 * 12/2012 Bailey ..... E21B 33/085 166/338
8,474,537 B2 * 7/2013 Voss ..... E21B 33/038 166/338
8,550,169 B2 * 10/2013 McKay ..... E21B 17/085 166/343
8,826,988 B2 * 9/2014 Gray ..... E21B 23/04 166/338
2010/0006298 A1 * 1/2010 Voss ..... E21B 33/038 166/338

* cited by examiner

CONNECTOR

This invention relates to a connector for connecting well servicing and like equipment together or connecting such well servicing equipment to well heads or the like. The invention particularly relates to a subsea connector for use in intervention systems and more particularly to a connector for making a connection between a high pressure riser and a well.

Our previous application GB2447645A (incorporated herein by reference) describes a known connector. WO2009/061211 also describes a known connector useful for understanding the invention.

During the drilling, maintenance and abandonment of subsea wells, rigid pipes, called risers, are suspended from vessels at the surface and extend to the subsea wellhead or christmas tree. The risers provide a conduit for tools being deployed to the well or recovered from the well, a conduit for fluids to be injected into the well or circulated back out of the well and a pressure containment barrier to the environment in the event of a kick or other well control event. Normally the surface vessel heaves with the surface wave movement, whereas the riser is rigidly connected to the seabed, so the riser typically incorporates a slip joint which absorbs the relative movement between the two. The drilling riser terminates below the drill floor of the vessel (which can be a rig or a ship) and the bore of the drilling riser is accessed from the drill floor through the rotary table.

During drilling operations a large bore low pressure riser from surface to seabed is normally used—typically 18¾" internal diameter. If high pressure well testing or fluid injection operations are to be performed, a secondary high pressure riser is required and is usually run inside the low pressure drilling riser to contain and convey the high pressure fluids. It is not possible to run the high pressure riser simultaneously with the low pressure riser, so this method of operation is very time consuming.

When high pressure risers are needed (for example, during wireline, well testing, well stimulation, coiled tubing drilling and through tubing rotary drilling (TTRD) operations) a small bore, high pressure riser can be used in open water rather than within the bore of a lower pressure drilling riser. This is typically referred to as a workover riser. Workover risers suffer the same dynamic heave problems as larger drilling risers, but presently available slip joints are typically unsuitable for small bore high pressure applications.

According to one aspect of the present invention there is provided a connector for connecting components of a subsea system extending between a wellhead and a surface structure, the connector comprising male and female components, and a latching device to releasably latch the male and female components together when the two are engaged, wherein the male and female components incorporate a first sealing device to seal the male and female components together to contain fluids passing between them when the male and female components are engaged, and wherein the latching device incorporates a second sealing device configured to contain fluids when the male and the female components are disengaged.

Typically the latching device comprises a seal disposed between a latch member and one of the components, and wherein the latch member moves between open and closed configurations of the latch, and wherein the seal remains active between the latch member and the component in each of the open and closed configurations. The seal can be provided in or on a surface of the latch member, or can be provided on another component and can seal against a surface of the latch member.

Optionally the latching device can comprise a dog member typically radially movable in a window in one of the components, wherein the dog member is configured to move radially in and out of engagement with a dog-receiving recess which can optionally be in the wall of the other of the components. More than one dog member and corresponding recess can be provided, e.g. 2, 3, 4, 5, 6 or some other multiplicity of dog members. Optionally the dog members are spaced circumferentially around the connector, typically in a symmetrical arrangement and optionally with substantially equal spacing between each dog member.

The dog members can optionally have flat upper and lower faces, to spread axial loads over a wider surface area, and reduce point loading on the dogs and windows during connection, but optionally dogs with arcuate faces can be used. Optionally the dog members can be generally square faced, optionally with rounded corners to distribute loads on the seals more evenly.

Optionally the dog member is provided on the female component.

The female component can optionally be located below the male component to receive the male component within the bore of the female component.

The window housing the dog member can typically extend entirely or only partially through the wall of the female component and the movement of the dog member can be constrained by the window so that the dog moves radially relative to the bore of the female component. The dog-receiving recess on the male component can optionally be provided in the outer wall of the male component. The recess optionally can pass radially through the entire wall of the male component, but advantageously passes through only a part of the wall, without passing entirely through the wall of the male component.

The second sealing device on the latching device can optionally be a lower pressure seal than the first sealing device. The second sealing device can optionally comprise an annular seal extending around the dog device, and suitable examples might comprise an o-ring seal and/or chevron and/or v-type seal, and/or a cup type seal. The second sealing device can optionally be provided in an annular recess. The annular recess can be provided on the dog device, or on the inner surface of the window that houses the dog device.

The second sealing device can be a unidirectional seal, but can optionally be bi-directional to contain fluids on each side of the seal. In some embodiments, the second sealing device can optionally be bi-directional but asymmetric in that it can optionally be configured to contain higher pressures on one side of the seal than on the other, for example the second sealing device can optionally be configured to be more effective at containing high pressures of fluid within the bore between the male and female components, compared with it's capacity to resist fluid passage from the outside to the inside of the connector.

Optionally the male component comprises an upper riser component extending at least part of the way between the surface structure (e.g. the rig or the intervention vessel) and the connector. The upper riser component is typically releasably connected to a socket on the female component by the latching device. The upper riser component is typically a high pressure riser section which can optionally be housed concentrically within the bore of a housing (such as a low pressure marine riser) which can optionally be supported by the surface structure. The upper riser component is typically adapted to contain high pressure well bore fluids.

The first sealing device between the male and female components is typically a high pressure seal which is adapted to contain the very high fluid pressures experienced by well bore fluids, and contain kicks and other well bore pressure events.

The female component typically comprises a lower riser component. The upper and lower riser components typically form a continuous high pressure riser through the connector allowing transfer of the high pressure wellbore fluids from the well to the surface through the connector, when the male and female components are engaged.

The connector is typically located below a slip joint, which is typically provided on the housing in the form of the low pressure marine riser assembly housing the male component of the high pressure riser.

The latching device passing through the window in the outer housing is typically sealed with a low pressure seal in order to contain fluids within the housing at a lower pressure than the wellbore fluids.

Embodiments of the invention obviate the requirement of a high pressure slip joint, and typically allow a high pressure open water riser to be run with a standard low pressure large bore slip joint above it attached by a crossover. During drilling operations, tools can typically be run into the well through the upper riser component; but to protect the conventional marine riser and low pressure slip joint from high pressure fluids, the upper riser component typically runs concentrically within the bore of the conventional low pressure marine riser from the drill floor down through the slip joint in order to engage the female component to which it is latched and sealed below the slip joint. The upper (male) riser component is typically kept in tension from the drill floor, whilst the lower (female) riser component below the slip joint is typically kept in tension e.g. by riser tensioners located below or beside the drill floor.

A string of wireline or coiled tubing tools can optionally be deployed in the upper riser component and suspended from the derrick or other structure at the surface. The length of the string can typically be less that the distance from the drill floor to the latch assembly, so that during tool change-outs the latching device can be disconnected and the upper riser component can optionally be hung off at the drill floor eliminating the relative movement between the riser extension and the drill floor, while the low pressure slip joint and the seal on the latching device advantageously contains fluids which may escape from the upper riser component after unlatching the male and female component. Sealing the latching component helps to prevent release of wellbore fluids to the environment.

Optionally the female component can connect to the housing (typically the low pressure conventional marine riser) and a seal can optionally be provided between the female component and the housing. The seal between the female component and the housing can optionally comprise a low pressure seal similar to the seal associated with the latching device. The upper end of the female component and the lower end of the housing can optionally be flanged, and the seal can be provided between the flanges. O-ring seals and/or chevron type seals and/or cup-type seals are suitable for this purpose. The seals between the housing and the female component and between the latch and the connector need only contain the wellbore fluids at relatively low temperatures, and therefore high performance seals are not necessary, but can nevertheless optionally be used.

Optionally the connector provides a small bore/large bore step in its inner diameter, typically providing a larger diameter portion above a smaller diameter portion. Optionally the connector can incorporate guide mechanisms for assisting preliminary orientation of the male component with respect to the female component and/or a connection mechanism for drawing the male component into the female component. Optionally, the guide mechanism comprises a tapered surface provided on the female component, for example, in the form of a cone provided on one end of the female component. Typically the surface of the cone is smooth to prevent any damage to the male component during initial contact with the surface.

Optionally, the guiding mechanism comprises a cone on the male component to assist in the initial guidance of the male component into the female component.

Optionally, the connection mechanism for drawing the male component into the female component comprises an abutment surface mounted within the female component.

The abutment surfaces of the male and female components are typically annular and optionally chamfered.

Optionally, the dog member of the latching device can be driven radially into engagement with the recess by a driver such as a hydraulic piston.

Conveniently, the male and female components can be provided with cooperating surfaces for establishing connection of hydraulic, electric or optical devices across the connector. Optionally, the cooperating surfaces are annular.

Optionally, hydraulic, electric or optical coupling devices are provided on the female component, said devices being actuable to extend through the cooperating surface of the female component into the cooperating surface of the male component to establish a connection across the connector.

Alternatively, hydraulic, electric or optical coupling devices are provided on the male component, said devices being actuable to extend through the cooperating surface of the male component into the cooperating surface of the female component to establish a connection across the connector.

According to a further aspect of the present invention there is provided a method of connecting components of a subsea system together comprising the steps of mounting a male connector on one component and a female connector on the other, guiding the male connector into the female connector and releasably latching the male component within the female component by means of a latching device, thereby sealing them together and permitting access axially through the connector, wherein the latching device incorporates a sealing device configured to contain fluids when the male and female components are disconnected.

According to a further aspect of the present invention there is provided a subsea system incorporating a connector according to the first aspect of the present invention.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention.

Various embodiments and aspects of the invention will now be described in detail with reference to the accompanying figures. Still other aspects, features, and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa.

All numerical values in this disclosure are understood as being modified by "about". All singular forms of elements, or any other components described herein are understood to include plural forms thereof and vice versa.

In the accompanying drawings.

Figure 1:
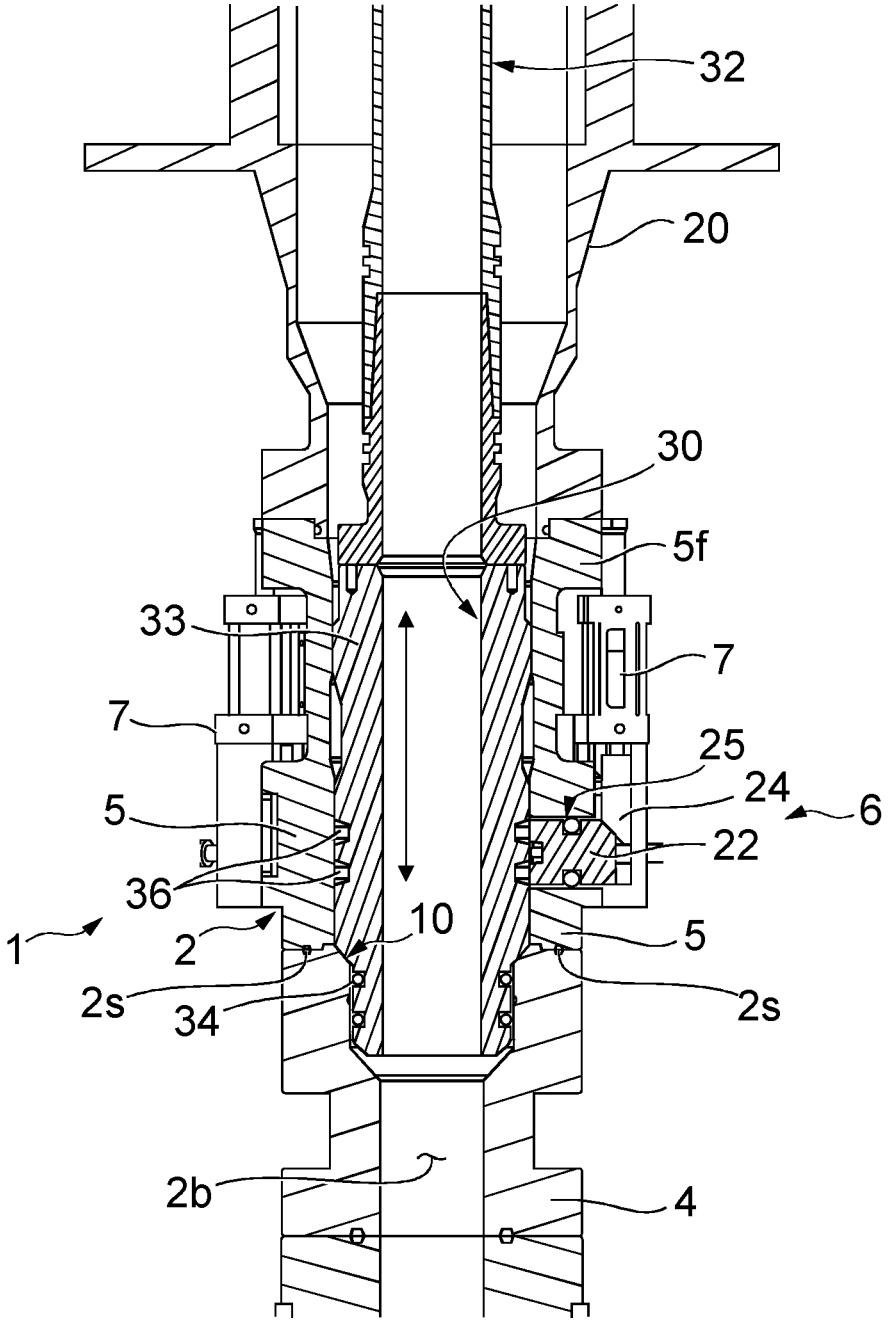
FIG. 1 is a schematic cross sectional view of a connector according to one aspect of the present invention.
Figure 2:
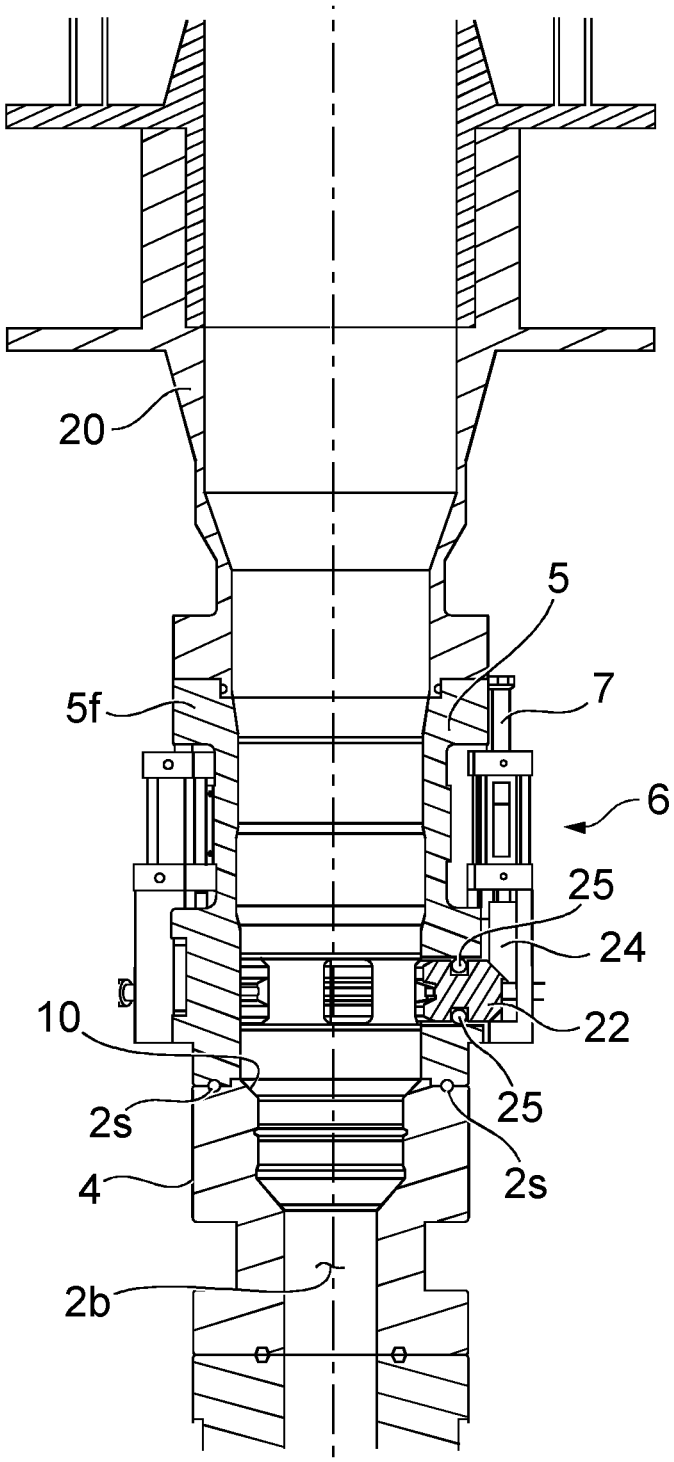
FIG. 2 is schematic cross sectional view of the female component of the connector of FIG. 1.
Figure 3:
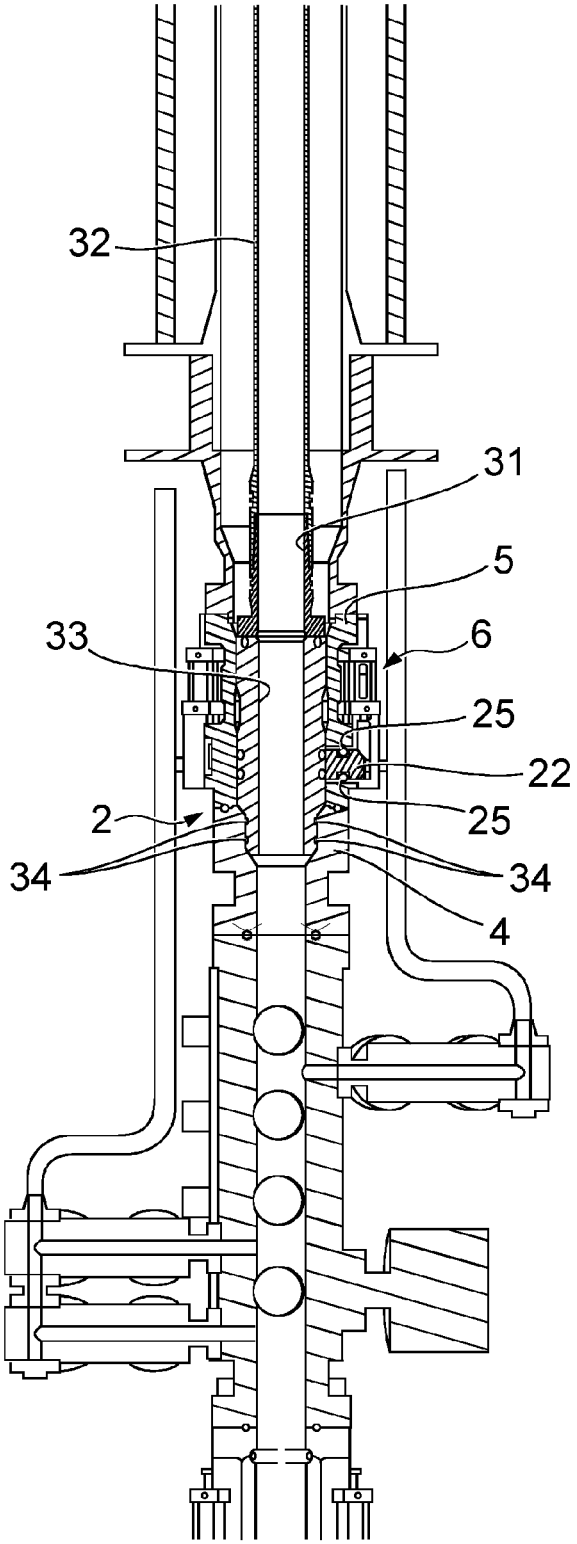
FIG. 3 is a schematic cross-sectional view through assembled connector of FIG. 1.

Referring now to the drawings, a connector 1 is shown for connecting together subsea components such as for example, a riser to a wellhead or two riser sections. The connector 1 comprises a female component 2 and a male component 30 each of which are adapted to be mounted in a known manner on an end of respective riser sections. The female component 2 is typically mounted on the upper end of a high pressure lower riser section extending from a well head, and the male component 30 is typically mounted on the lower end of an high pressure upper riser section extending down from a surface structure such as a rig or drill ship or intervention vessel, and is typically rated to contain and convey high pressure fluids between the rig and the HP section of the lower riser, typically forming a co-axial HP conduit within the low pressure bore of the upper riser 20.

The female component 2 can typically be a one piece component, but in this embodiment the female component 2 typically has two separate parts, typically connected together and typically having a high pressure seal between them. In particular the female component 2 typically comprises a hollow cylindrical seal housing 4 and latch housing 5 which in this embodiment have concentric bores and are stacked so that the bore 2*b* extends through the housings 4, 5 typically in line with the axis of the housings 4, 5. A seal 2*s* is typically provided between the housings 4, 5. The seal 2*s* can optionally be a low pressure seal. In some embodiments the housings 4, 5 can be formed from more than two components. The seal housing 4 is typically a high pressure (HP) component adapted to connect to the lower HP riser section below the connector and the inner bore of the housing 4 typically bears the seal surfaces into which the male component seals. These can optionally comprise polished, hardened or metal to metal seal surfaces, and are typically configured to contain the high pressure fluids within the inner HP riser conduit.

The latch housing 5 is typically a low pressure structural component which carries a latching mechanism 6 and which connects between the seal housing 4 at its lower end and a large bore low pressure riser/slip joint assembly 20 at the upper end, to which it is typically sealed by a high pressure seal, or a low pressure seal. The male component 30 typically carries at least a portion of the first sealing device (which typically comprises elastomeric seals but may also be metal-to-metal) and engages with the seal surfaces on the main body at the lower end, and attaches to the lower end of the high pressure upper riser portion at the upper end. The configuration shown in the figures with the external HP seals on the lower end of the male component 30 engaging the internal seal surfaces of the female component is only one possibility, and these can optionally be reversed in other embodiments.

The upper end of the latch housing 5 typically has a flange 5*f*, which extends radially from the bore 2*b*. The flange 5*f* can optionally have seal faces and annular recesses for seal bodies such as o-rings, chevrons, v- or cup-type seals, and axial bolt holes for securing the flange to the flange 20*f* of the low pressure marine riser assembly 20 above it, as will be described below. The seals between the LP riser assembly 20 and the latch housing 5 do not need to be high performance HP seals, but such seals could optionally be used in this location.

The latching mechanism 6 typically comprises a dog system that drives dogs radially through the female component 2 into engagement with the male component 30 located in the bore of the female component 2. The outer surface of the latch housing 5 has a number of latch actuation devices in the form of hydraulic cylinders 7 which are typically axially mounted on the outer surface of the latch housing 5. The hydraulic cylinders 7 can optionally be operated or powered from an ROV or can be directly overridden by an ROV if necessary in the event of hydraulic failure. The latch actuation device may be a piston, mechanical finger or lever arm or another type of mechanism.

The upper end of the bore 2*b* of the seal housing 4 is typically provided with a chamfered edge. The chamfer assists in guidance of a male component of the connector into the female component as will be described more fully below. Below the chamfer the bore of the seal housing 4 has a smaller diameter than the portion above the upper chamfer. The seal housing 4 optionally has a lower portion having a narrow diameter than the upper portion, and has a lower chamfer forming a neck between the lower portion and the upper potion. The chamfer on the neck also assists in guidance of a male component of the connector into the female component.

The slope of the internal face of the chamfers may be selected depending upon the configuration of the connector. The chamfered faces are typically smooth in order to prevent any damage to the male component of the connector during insertion. The inner diameter of the bore 2*b* below the lower chamfer is slightly smaller than the outer diameter of the male component 30.

The chamfered edges form substantially annular (optionally metal) abutment surfaces 10 is formed within the bore 2*b*. The upper chamfer 10 usually serves as the abutment surface to limit the axial travel of the male component into the bore 2*b*.

One or more formations (not shown) may be provided in the inner surface of the bore 2*b* to receive a locating key of a male component to assist in rotational alignment of the components. In an alternative arrangement, the formations may be provided in the male component and the locating keys provided on the abutment surface of the female component.

The female component has a latching device 6 in the form of a number of dog members 22 provided within radially extending windows passing radially through the wall of the female component for mechanically retaining a male component of the connector in position within the female component. More than one dog can be provided, and in this embodiment, there are 5 dogs, typically spaced equidistantly around the circumference of the latch housing 5.

In this embodiment, the latching device is actuated by the hydraulic cylinders 7 secured to the outer surface of the latch housing 5 of the female component. A wedge device 24 is mounted on the end of the piston carried within the cylinder 7. In an alternative arrangement (not shown) the wedge device 24 may be integral with the piston. The wedge device 24 is constrained by a frame to slide axially down the outer surface of the latch housing 5 of the female component 2 underneath the hydraulic cylinder 7. The lower surface of the wedge device 24 remote from the cylinder 7 may be tapered. The outer surface of the dog 22 has a tapered surface facing the tapered surface of the wedge device 24. Optionally the dog 22 is constrained to move radially within the window through the wall of the latch housing 5, and can optionally have a spline or other profile (e.g. a square profile) controlling (e.g. restricting) its movement (e.g. its rotation) in the window.

Axial movement of the piston within the cylinder 7 moves the wedge device 24 axially within the confines of the frame down the outer surface of the latch housing 5 of the female component 2. As the tapered surface of the wedge device 24 is raised and lowered, the dog 22 is moved radially inwardly or outwardly through the window of the latch housing 5, thereby engaging or disengaging with the male component received in the bore 2*b*. Other actuation mechanisms can be used instead of or in addition to the hydraulic cylinders and wedge device, for example cam devices etc.

The second sealing devices are typically provided on the outer surface of the dogs 22 in the form of seals 25. Low pressure O-ring seals or the like can suffice, and the seals 25 can optionally include components of o-rings, chevron seals, v-type or cup seals, etc. More than one design of seal can be used in the seals 25, e.g. the seals 25 can optionally incorporate a chevron seal element and an o-ring element, etc. Optionally the seals 25 are optimised for retaining fluid within the bore 2*b* of the female component 2, but seals 25 can optionally be bi-directional. The seals 25 are typically located in an annular recess in the form of a seal groove 26 extending around the outer circumference of the dog 22. The dog can optionally have flat faces, e.g. flat upper and lower faces, typically facing the axial directions of the bore 2*b*, in order to resist axial loads on a wider area, and can optionally have rounded edges to avoid pinching the seals at the corners of the dog 22. The seal grooves can be spaced from the bore 2*b*, and are typically not located within a region of the interface between the dog and the window that is exposed during the radial travel of the dog between the open and closed configurations, so that the seal is not moved over the edge of the window or the dog member on each cycle of movement of the dog member.

The seal grooves housing the seals can optionally be provided on the inner walls of the window that retain the dogs or on the dogs 22 themselves, but in either case, the radial extent of movement of the dog 22 within the window through the wall of the latch housing 5 is limited and the radial travel of the dog within the window is typically insufficient to expose the seal on one side of the window or the other, so that whether the dog 22 is radially extended inwards, or radially withdrawn outwards, the seal 25 is still retained in the groove 26 and is compressed between the dog 22 and the window of the female component, so that pressure is retained by the seal 25 irrespective of the open or closed configuration of the latching device.

The male component 30 of the connector is mounted on the lower end of a riser 32, typically via an HP adapter 31. The riser 32 is typically a high pressure riser which typically extends to the surface and is suspended from a stuffing box or some other piece of equipment, and is typically housed co-axially within the low pressure marine riser 20 that incorporates a slip joint of conventional design (see FIGS. 4-6), suspended from the vessel. The riser 32 does not need to be co-axial with the low pressure riser 20, but can be in certain embodiments.

The male component 30 comprises a hollow tubular mandrel 33 through which HP fluids can pass (optionally within other conduit strings within the bore of the male component 30) from the upper section of the riser 32 through the connector 1 and into the lower riser section below the connector 1, or in the opposite direction. The free end of the mandrel 33 is typically chamfered to aid insertion of the free end into the female component 2.

The lower end of the outer circumference of the mandrel 33 carries at least a portion of the first sealing device in the form of high pressure seal 34 to prevent HP fluids within the riser 32 from breaching the connector 1. The main seal of the connector may be elastomeric or may be a metal to metal seal. In the embodiment shown the seal is provided by one or more resilient O-ring seals which are tightly secured around the mandrel 33. Other types of seal can be used if desired. Multiple seals can be stacked on the mandrel in an axial arrangement to increase the efficiency of the seal.

The diameter of the mandrel 33 above the main seal 34 is enlarged through a flared skirt. Recesses in the form of annular detents 36 are provided on the mandrel 33 for locking the male component 30 within the female component 2.

The lower end of the upper section of the mandrel 33 terminates in a chamfer 42, which is tapered to the free end of the male component 30, and typically the taper matches the angle of the lower chamfer in the neck of the bore of the female component 2.

Figure 4:
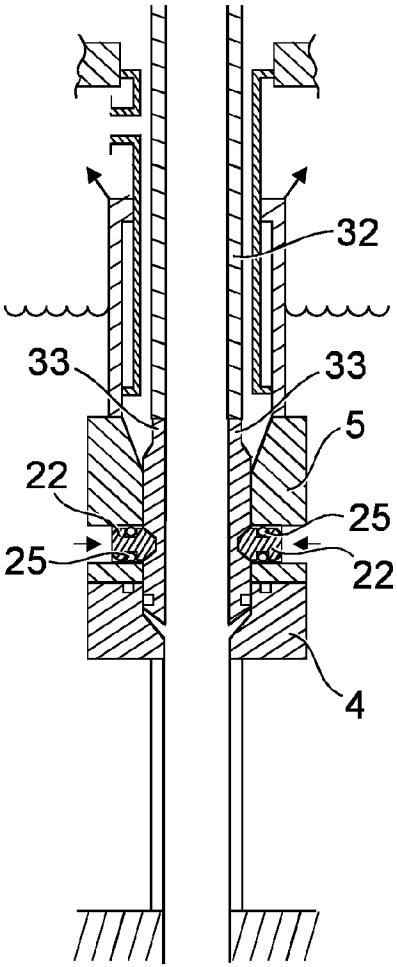
FIG. 4 is further schematic view of the connector of FIG. 1.
Figure 5:
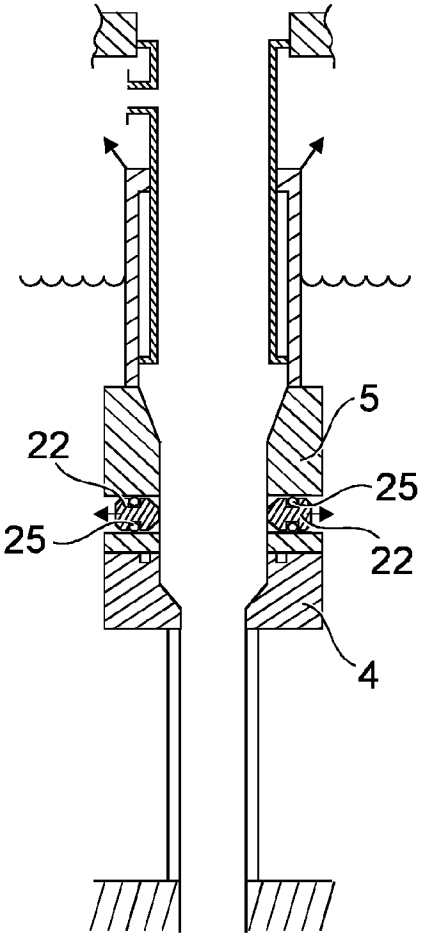
Figure 7:
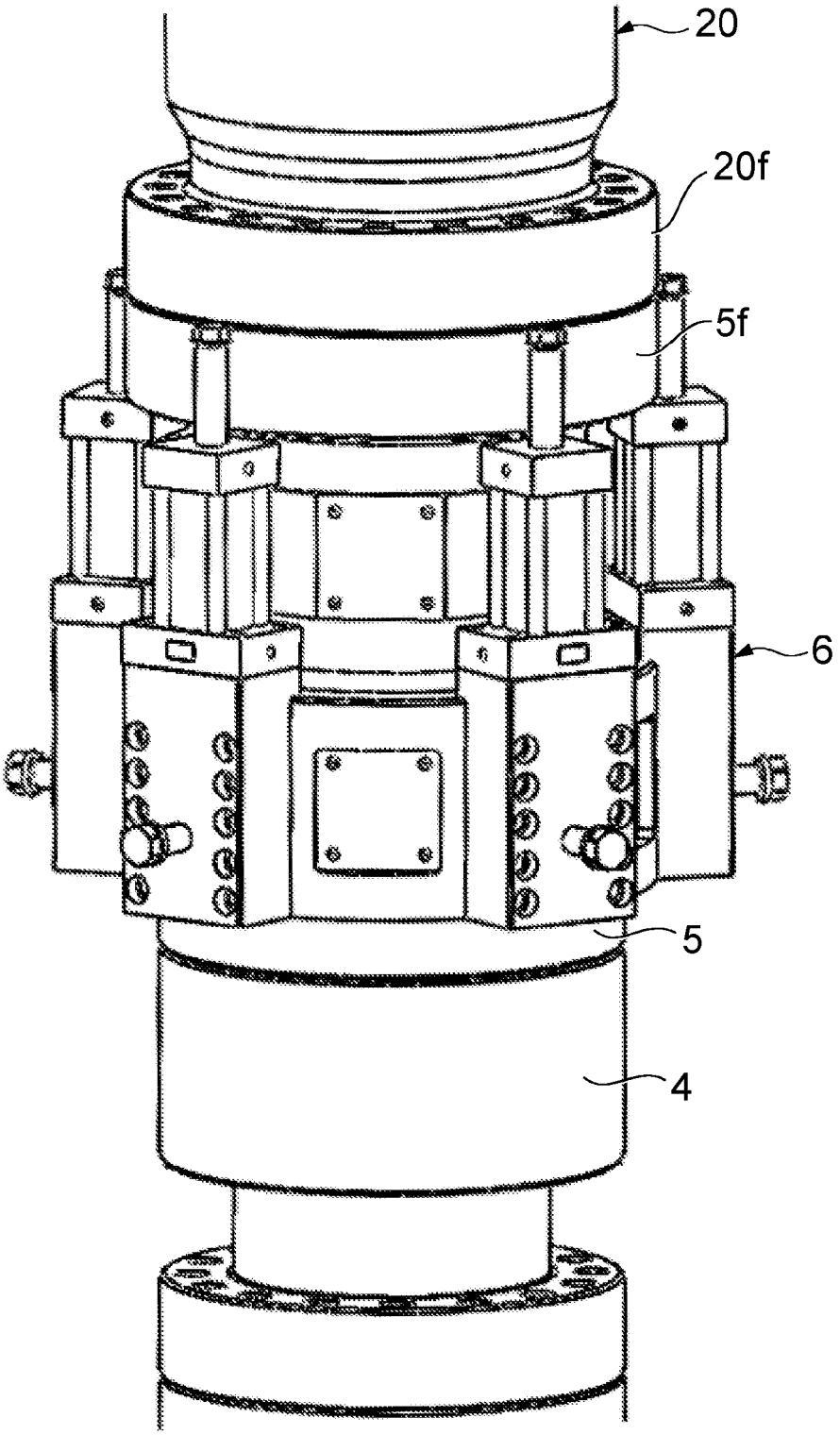
FIGS. 7 and 8 are perspective views of the FIG. 1 connector showing more details concerning the dogs.
Figure 8:
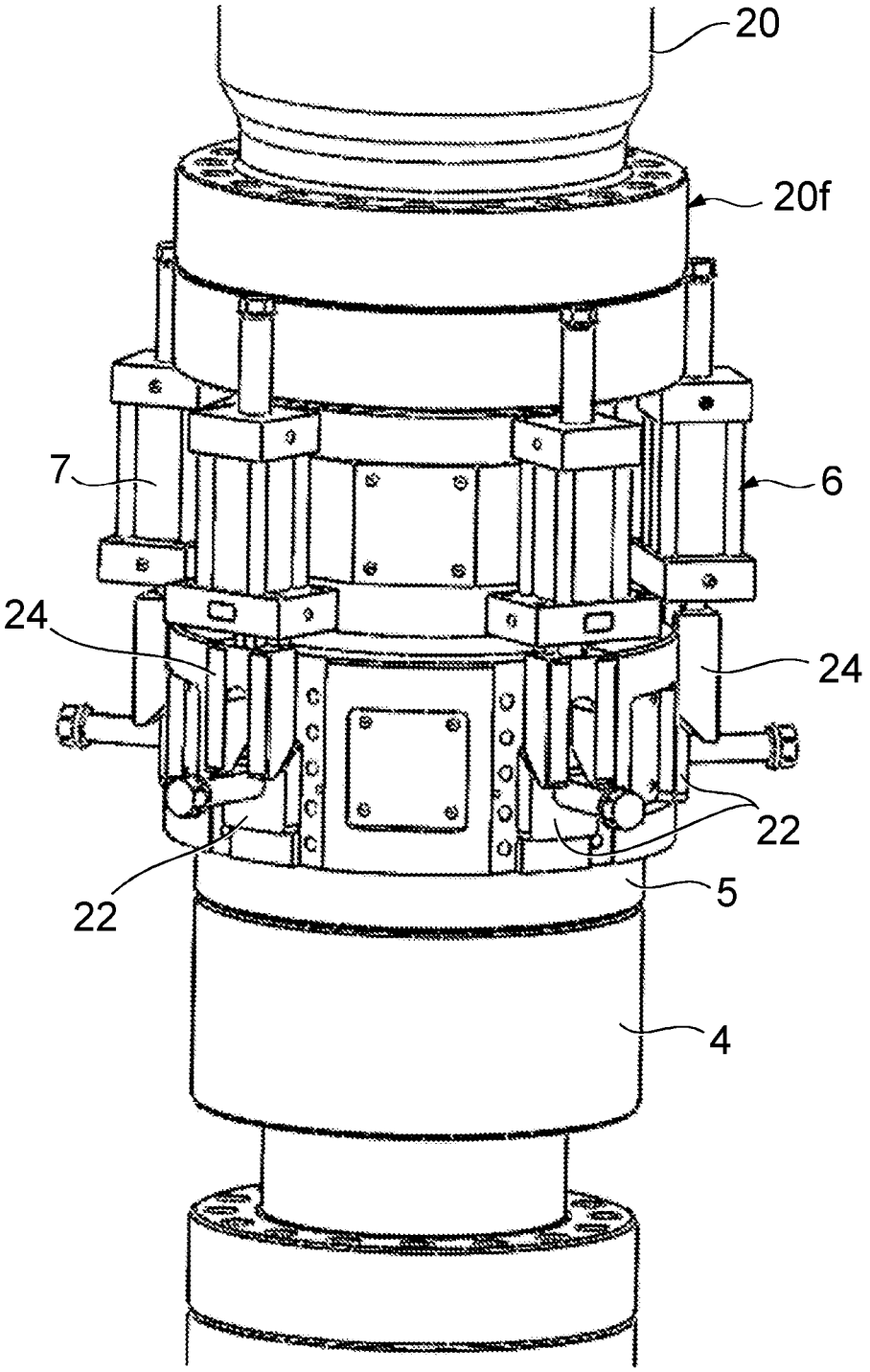
Figure 9:
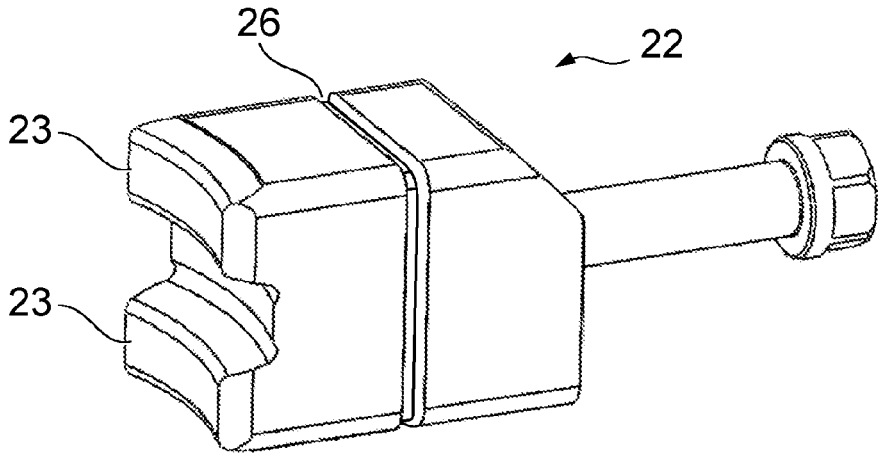
FIG. 9 is a perspective view of a dog used in the FIG. 7 connector.
Figure 10:
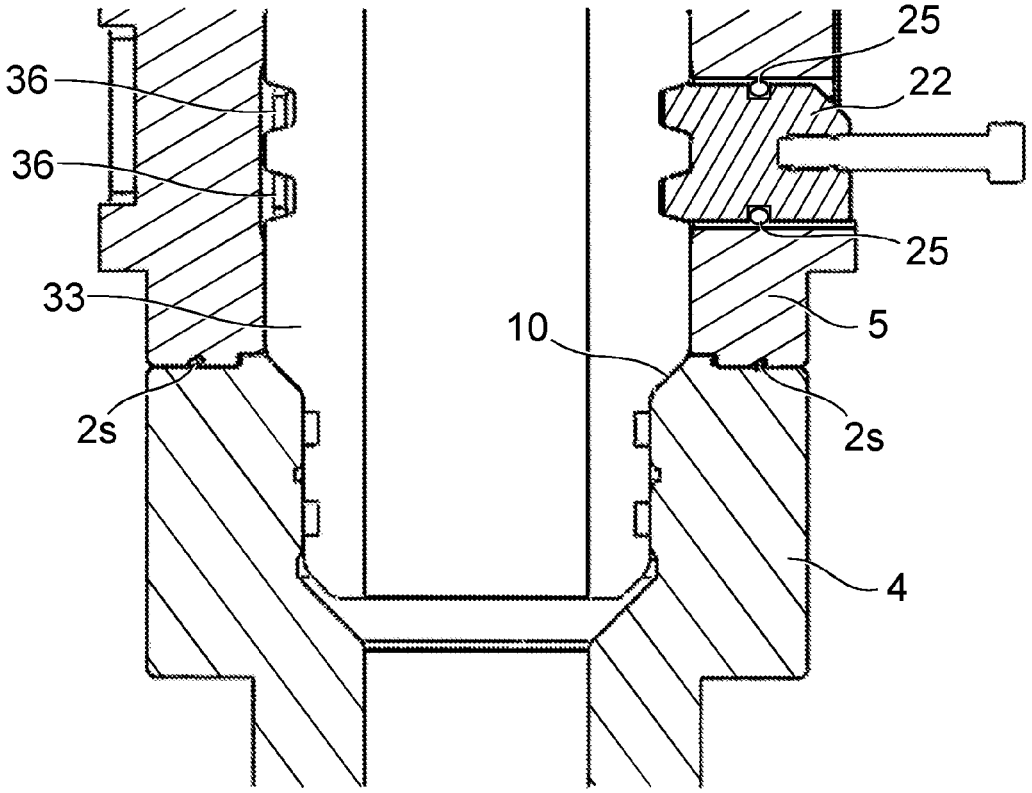
FIG. 10 is a side sectional view of the FIG. 7 connector when the dogs are engaged.
Figure 11:
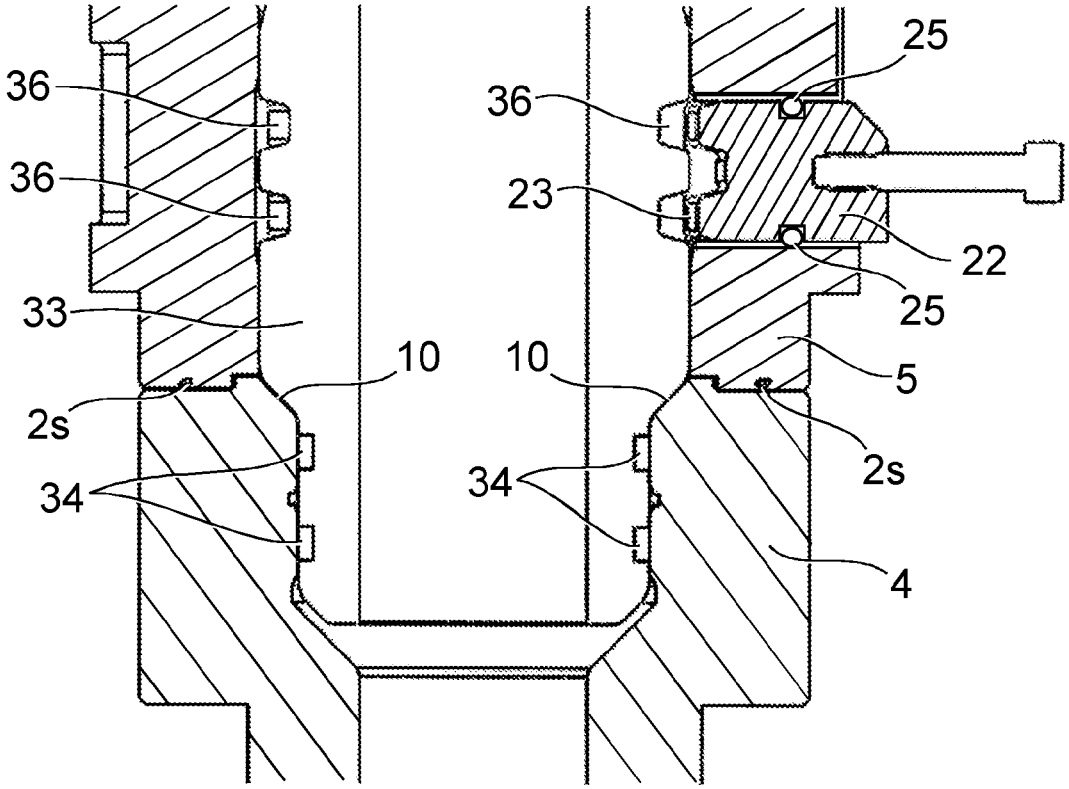
FIG. 11 is a side sectional view of the FIG. 7 connector when the dogs are disengaged.

The operation of the connector will now be described. The female component 2 of the connector is mounted on the upper free end of a lower riser section or the like by flange connection, push fit connection, threaded connection or any other suitable connecting mechanism. The female component connects the HP lower riser to the low pressure (LP) upper riser, providing a fluid conduit sufficient to contain and convey low pressure fluids as shown in the configuration of FIG. 4. The connection between the LP female component 2 and the HP lower riser assembly is typically provided with HP seals, configured to contain HP fluids. The male component 30 of the connector 1 is mounted on the lower end of an upper riser section. There may be a push fit connection between the free end of the nozzle of the male component or a screw thread mounting or other suitable fixing may be provided. The flange 5*f* at the upper end of the female component 2 is bolted to a flange 20*f* on the lower portion of the conventional low pressure marine riser 20, which typically incorporates a slip joint of known design above the connector 1.

In a typical sub sea connection, it is likely that the male component will be lowered towards the female component although other configurations are also considered suitable.

The upper riser portion 32 is lowered through the LP marine riser 20, towards the female component 2 secured between the lower end of the marine riser 20 and the upper end of the lower HP riser assembly. As the male component 30 approaches the female component 2 of the connector 1, the free end of the hollow mandrel 33 of the male component 30 is guided by an upper wide diameter mouth of the female component 2. As the male and female components approach one another, the dogs 22 are typically held in a withdrawn configuration, radially retracted from the bore 2*b*, and do not engage with the male component 30, so that they do not impede the insertion of the male component 3 into the female component 2, which thereby helps to prevent damage to the connectors during insertion.

As the hollow mandrel 33 of the male component 30 moves into the bore 2*b*, the main seals 34 of the tubular mandrel pass through the neck and into the small diameter lower portion of the female component 2 beneath the upper chamfer 10, so that the seals 34 are compressed between the two components 2, 30 and the high pressure fluid within the bore of the riser is thereby contained. The mandrel 33 of the male component moves down the bore 2*b*, and the chamfered lower edge of the end of the mandrel 33 approaches the upper chamfer 10 of the female component. The components are dimensioned such that when the chamfered lower edge on the end of the mandrel 33 abuts against the upper chamfer 10 on the female component 2, the dogs 22 on the female component 2 are axially aligned with the grooves 36 on the outer surface of the mandrel 33. Once the dogs 22 are aligned with the grooves 33, the axial hydraulic cylinder(s) 7 are actuated to apply an axial force to the wedge devices 24, which thereby drive the dogs 22 radially into the grooves 36, connecting the male and female components together. Axially spaced teeth 23 on the inner surface of the dogs 22 then penetrate adjacent grooves 36, which locks the male and female components together against axial movement. The upper and lower surfaces of the teeth 23 can be tapered to force the mandrel 33 axially downward into the socket of the female component 2 into a final secured position.

Figure 6:
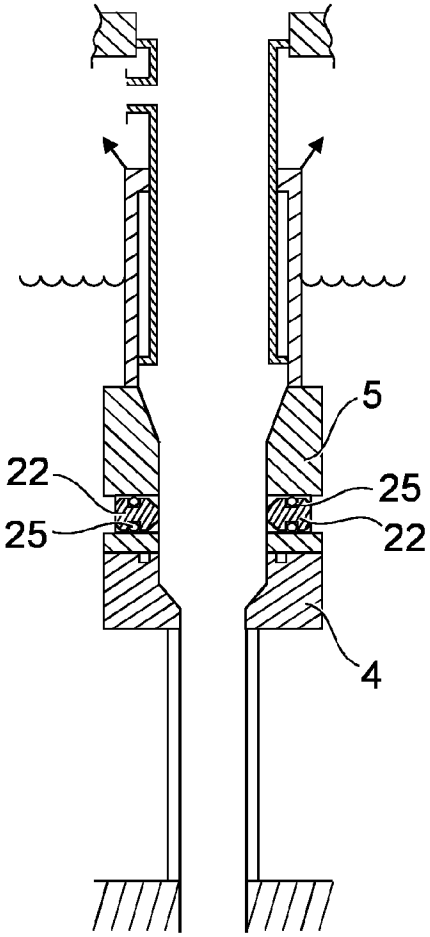
FIGS. 5 and 6 are views similar to FIG. 4 showing the female component disconnected from the male component.

The main seal 34 of the connector is established between the male and female components, and is effective to retain high pressure wellbore fluids which pass through the bore of the engaged connectors, as shown in FIG. 4. However, when the dogs 22 are withdrawn so that the male and female components are disconnected, as shown in FIGS. 4 and 6, and the upper riser portion and male component 30 is withdrawn upwards towards the surface, the female flange 5*f* on the upper surface of the latch housing 5 is still connected to the flange 20*f* on the lower surface of the low pressure riser housing. In this configuration, when the male and the female components are disengaged, the secondary seal 25 on the dog members 22 contains any fluids escaping from the high pressure riser and prevents their escape into the surrounding environment. Optionally, the LP riser bore can be empty, as shown in FIG. 6, and the seals 25 on the dogs 22 prevent seawater ingress from outside the bore of the riser.

When it is required to disconnect the two riser sections from one another the operation for connecting the two components of the connector are reversed.

The connector serves the function of providing a primary barrier to high pressure well fluids in the form of the first sealing device while withstanding internal pressure forces and all externally applied forces. The connector of the present invention combines this basic function with the added function required for subsea use while keeping a secondary barrier in the form of the second sealing device 25 engaged irrespective of the state of connection of the male and female components. Therefore any leakage or failure of hydraulic seals cannot create communication between the well bore and the environment.

Figure 12:
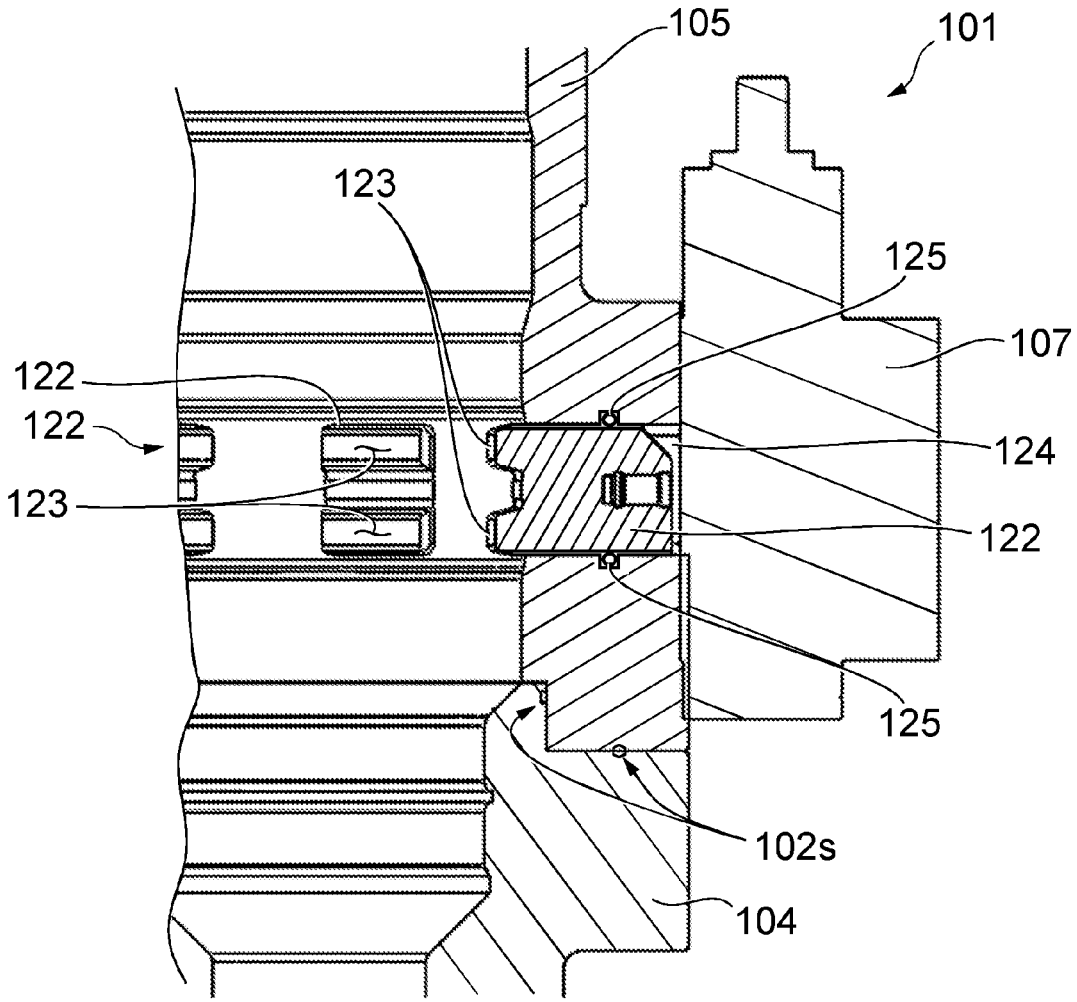
FIG. 12 is a partial section view from the front showing one side of a female component of an alternative design of connector.
Figure 13:
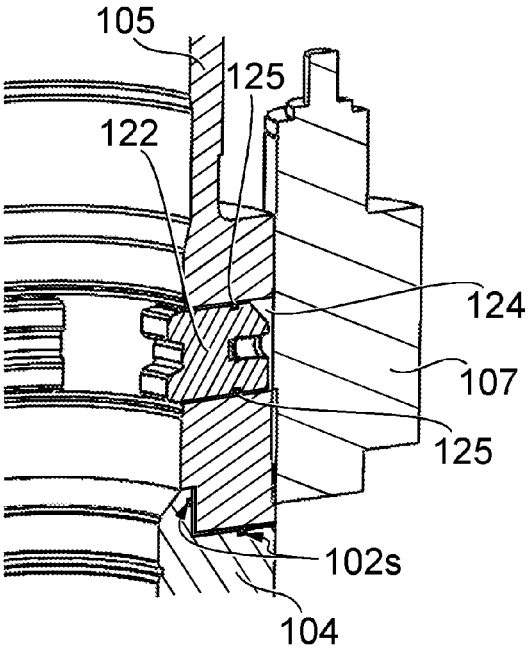
FIG. 13 shows a perspective view of the FIG. 12 arrangement showing one side of the alternative connector.
Figure 14:
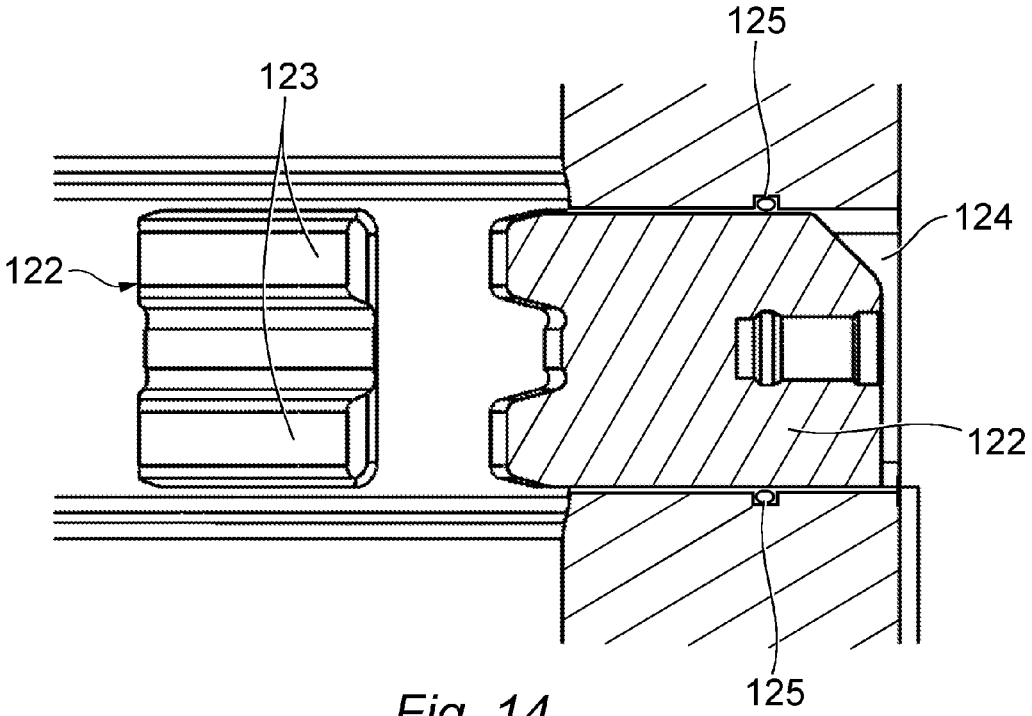
FIG. 14 shows an enlarged view of a dog in the FIG. 12 connector.

Referring to FIGS. 12 to 14, an alternative design of connector 101 has similar features as described for the earlier embodiment, and reference numbers for those features of the second embodiment 101 will be similar to those used in relation to earlier embodiments, with the difference that reference numbers for the features of the second embodiment will be increased by 100.

The second embodiment of the connector 101 has a seal housing 104 and a latch housing 105 as previously described. The latch housing 105 has dogs 122 housed in respective windows 124 passing radially through the walls of the latch housing 105. The dogs 122 move radially in the windows 124 as described for the dogs 22, and typically have teeth 123 at their radially inner edges that engage in outwardly facing grooves in a male component received within the bore of the latch housing 105, as previously described. The difference between the first and second embodiments lies in the arrangements of the seals surrounding the dog within the window. In the second embodiment of the connector 101, the seals 125 are housed in recesses formed on the inner surfaces of the windows 124 instead of the outer surfaces of the dogs 122. As previously described, the seals 125 can be uni- or bi-directional, and can comprise O-ring seals, chevron or V-type seals or cup-type seals, or other types of seal. Typically the seals 125 comprise annular rings and extend entirely in an unbroken line around the dog 122. The seals 125 are typically compressed between the dog 122 and the inner surface of the window 124. thereby denying fluid passage between the inside of the bore of the latch member 105 and its outer surface, through the window 124. The seals 125 thereby retain fluids within the bore of the latch housing 105, and also typically prevent fluid ingress through the windows in the opposite direction. Typically, the movement of the dog 122 is limited to a specific range of movement that maintains the seal 125 in compression between the dog 122 and the inner surface of the window 124, so that the seal 125 does not pass radially out of the window 124, and thereby remains compressed and effective to deny fluid passage through the window 124 when the dog 122 is in place.

The female housing typically acts as the small bore/large bore crossover and typically also supports the latching mechanism and female sealing surfaces. The male high pressure mandrel can optionally carry the main seals but these could be reversed and the main seals can optionally be provided on the female component.

Certain embodiments of the invention permit the combination of a latching arrangement and a high pressure/low pressure crossover into a single unified assembly. Some embodiments permit an assembly that is configured with a latching mechanism that penetrates the crossover in order to engage with and secure the high pressure mandrel while also being capable itself of sealing against the low pressure fluids when the high pressure mandrel is not present.

In the embodiment of the invention shown the locking mechanism consists of a series of locking dogs arranged around the outer circumference of the main housing. These dogs are functioned radially inwards to engage with the high pressure mandrel to secure it and complete the high pressure conduit. Each individual dog itself has a seal fitted which maintains a low pressure seal from inside to outside the main housing. This seal remains in effect as the dog functions inward and outward to engage and disengage from the high pressure mandrel.

The secondary seals on the latch housing are typically not exposed to fluid in the well bore, debris or added stimulation fluids in the normal operation. This aids in keeping the materials concerned free from corrosion and also helps to prevent the possibility of seizure of a mechanism by means of accumulated debris.

Optionally the male and female components can incorporate anti-rotation mechanisms to resist relative rotation, and to maintain rotational alignment between the two components, for example, by means of a spline.

Modifications and improvements can be incorporated without departing from the scope of the invention.

The invention claimed is:

1. A subsea riser system adapted to extend between a subsea wellhead and a surface structure, the subsea riser system having an upper riser component, a lower riser component, and a connector comprising:

a male connector component on the upper riser component and a female connector component on the lower riser component, the male and female connector components being adapted to engage one another to make up the connector and to connect the upper riser component to the lower riser component, the upper riser component comprising a high pressure fluid conduit adapted to extend between the surface structure and the female connector component when the connector is made up; wherein the subsea riser system has a low pressure riser assembly supported from the surface structure and adapted to extend between the surface structure and the female connector component on the lower riser component, and wherein the high pressure fluid conduit of the upper riser component is housed within a bore of the low pressure riser assembly, the female connector component having a bore, and the connector having a latching device to releasably latch the male and female connector components together when the two are engaged; and wherein the male and female connector components incorporate a first sealing device to seal the male and female connector components together to contain fluids passing between them when the male and female connector components are engaged; and a second sealing device configured to contain fluids within the bore of the low pressure riser assembly when the male and the female connector components are disengaged;

wherein the latching device comprises at least one dog radially movable within a window, said window extending radially at least partially through one of the male and female connector components, the at least one dog being radially movable into and out of engagement with a dog-receiving recess on the other of the male and female connector components;

wherein the at least one dog has upper and lower faces facing the axial directions of the bore of the female component, and wherein each of the upper and lower faces of the at least one dog is flat;

wherein the second sealing device comprises an annular seal extending around the flat upper and lower faces of the at least one dog, wherein the second sealing device forms a seal between the window and the at least one dog.

2. The subsea riser system as claimed in claim 1, wherein the latching device comprises the second sealing device provided on a surface between a latch member and one of the components, and wherein the latch member moves between open and closed configurations of the latch member, and wherein the second sealing device remains active between the latch member and the component in each of the open and closed configurations.

3. The subsea riser system as claimed in claim 1 having more than one dog and corresponding recess spaced circumferentially around the connector.

4. The subsea riser system as claimed in claim 1, wherein the movement of the at least one dog is constrained by the window so that the at least one dog moves radially relative to the bore of the female connector component into a recess on the outer surface of the male connector component.

5. The subsea riser system as claimed in claim 1 wherein the second sealing device is retained in an annular recess.

6. The subsea riser system as claimed in claim 1, wherein the second sealing device on the latching device has a lower pressure rating than the first sealing device.

7. The subsea riser system as claimed in claim 1, wherein the second sealing device comprises a unidirectional seal.

8. The subsea riser system as claimed in claim 1, wherein the second sealing device comprises a bi-directional seal configured to contain fluids on each side of the seal.

9. The subsea riser system as claimed in claim 8, wherein the second sealing device is asymmetric and is configured to contain higher pressures on one side of the seal than on the other.

10. The subsea riser system as claimed in claim 9, wherein the second sealing device has an inside surface and an outside surface, and wherein the second sealing device is configured to contain higher pressures of fluid at the inside surface than at the outside surface.

11. The subsea riser system as claimed in claim 1, wherein the upper riser component comprises the high pressure fluid conduit with a high pressure bore adapted to contain high pressure well bore fluids between the surface structure and the connector.

12. The subsea riser system as claimed in claim 11, wherein the upper riser component is releasably connected to a socket on the female connector component by the latching device.

13. The subsea riser system as claimed in claim 11, wherein the upper and lower riser components form a continuous high pressure riser through the connector allowing transfer of the high pressure wellbore fluids from the wellhead system to the surface through the connector, when the male and female connector components are engaged.

14. The subsea riser system as claimed in claim 1, having a small bore to large bore step in an inner diameter of the bore of the female connector component, permitting connection of a large bore low pressure conduit above the connector to a small bore high pressure conduit below the connector.

15. The subsea riser system as claimed in claim 1, incorporating at least one guide mechanism for assisting preliminary orientation of the male connector component with respect to the female connector component.

16. The subsea riser system as claimed in claim 1, the male and female connector components having cooperating surfaces, the connector including hydraulic, electric or optical coupling devices configured to extend through the cooperating surfaces of the male and female connector components to establish a connection across the connector.

17. The subsea riser system as claimed in claim 1, wherein the female connector component is attached to a lower end of the low pressure riser assembly having a large said bore, the low pressure riser assembly having an upper end connected to a tensioning mechanism adapted to accommodate relative movements of the surface structure relative to the subsea wellhead resulting from heave.

18. The subsea riser system as claimed in claim 17, wherein the system incorporates a slip joint above the connector, to accommodate relative movements of the surface structure and the subsea wellhead.

19. The subsea riser system as claimed in claim 1, wherein the high pressure fluid conduit is suspended from a motion compensator assembly configured to accommodate relative movements of the surface structure and the subsea wellhead.

20. The subsea riser system as claimed in claim 1, wherein the latching device incorporates a piston assembly arranged on one of the male and female connector components and actuable to engage each dog to drive the dog radially within the window.

21. The subsea riser system as claimed in claim 20, wherein each piston assembly comprises a piston movable within a hydraulic cylinder, each piston comprising a wedge device adapted to engage a tapered outer surface of the dog facing the tapered outer surface of the wedge device, whereby axial extension of the piston within the cylinder drives the dog radially inward within the window into engagement with the dog-receiving recess.

22. The subsea riser system as claimed in claim 21, wherein the piston has a flat section disposed axially between the hydraulic cylinder and the wedge device, and wherein the dog has a flat outer section disposed adjacent to the tapered outer surface, and wherein the flat section of the piston is adapted to engage the flat outer section of the dog.

23. The subsea riser system as claimed in claim 1, wherein the at least one dog has an inner surface provided with at least one tooth, and wherein the dog-receiving recess has at least one corresponding groove adapted to receive said at least one tooth, wherein said at least one tooth has upper and lower surfaces which are tapered, and which engage the corresponding grooves in dog-receiving to force the male connector portion axially into the female connector component.

24. The subsea riser system as claimed in claim 1, wherein the first sealing device is disposed on a lower end of the male connector member on a narrow diameter portion axially below a larger diameter portion comprising a flared skirt on the male connector member.

25. The subsea riser system as claimed in claim 24, wherein the female connector component has an upper end adapted to receive the lower end of the male connector component, and wherein the upper end of the female component has an upper chamfer and a lower chamfer within the bore of the female component, wherein the upper chamfer is adapted to engage the flared skirt of the male connector member to restrict axial movement of the male connector into the female connector, and wherein the bore of the female connector component below the lower chamfer has the same diameter as the bore of the male connector above the flared skirt.

26. A method of connecting first and second parts of a subsea system together, the method comprising:

mounting a male connector component on a upper riser component comprising the first part, and mounting a female connector component on a lower riser component comprising the second part, the male and female connector components each having a bore, and the upper riser component comprising a high pressure fluid conduit adapted to extend between a surface structure and the female connector component when the connector is made up;

connecting a low pressure riser assembly between the surface structure and the female connector component on the lower riser component, the low pressure riser assembly having a bore;

housing the high pressure fluid conduit of the upper riser component within the bore of the low pressure riser assembly;

guiding the male connector component into the bore of the female connector component and releasably latching the male connector component within the bore of the female connector component by means of a latching device, thereby sealing the male connector component and the female connector component together and axially connecting the bores of the male and female connector components, and thereby connecting the high pressure fluid conduit of the upper riser component to the lower riser component;

the latching device comprising at least one dog radially movable within a window, said window extending radially at least partially through one of the male and female connector components, the at least one dog being radially movable into and out of engagement with a dog-receiving recess on the other of the male and female connector components;

wherein the at least one dog has upper and lower faces facing the axial directions of the bore of the female component, and wherein each of the upper and lower faces of the at least one dog is flat;

wherein the latching device incorporates a sealing device comprising an annular seal extending around the flat upper and lower faces of the at least one dog, the annular seal forming a seal between the window and the at least one dog to contain fluids when the male and female connector components are disconnected;

wherein the method includes the step of containing the fluids within the bore of the low pressure riser assembly by means of the sealing device when the male and female connector components are disconnected.

* * * * *